United States Patent [19]

Grime et al.

[11] 4,243,870

[45] Jan. 6, 1981

[54] VAPORIZER WITH ELECTRODE HOUSING INTERLOCK

[75] Inventors: Thomas E. Grime, Temperance, Mich.; Frank A. Robinson, Jr., Toledo, Ohio

[73] Assignee: Champion Spark Plug Company, Toledo, Ohio

[21] Appl. No.: 876,467

[22] Filed: Feb. 9, 1978

[51] Int. Cl.[3] ..... H05B 3/60; B65D 55/02; E05B 11/00

[52] U.S. Cl. ..... 219/295; 70/389; 219/272; 219/314; 219/322; 219/437; 220/210; 220/293; 220/300; 220/301

[58] Field of Search ..... 219/284–295, 219/271–276, 437, 441, 438, 442, 322, 314; 220/210, 293, 301, 300; 70/389

[56] References Cited

U.S. PATENT DOCUMENTS

| | | | |
|---|---|---|---|
| 909,785 | 1/1909 | Hall | 220/210 |
| 972,000 | 10/1910 | Hofer | 220/210 |
| 1,164,197 | 12/1915 | Kildear | 220/301 X |
| 1,230,342 | 6/1917 | Thornberg | 219/274 |
| 1,341,592 | 5/1920 | Ruehle | 220/300 |
| 1,936,207 | 11/1933 | Penn | 220/210 X |
| 2,469,018 | 5/1949 | Swanson | 70/389 |
| 2,693,100 | 11/1954 | Wiegel | 70/389 X |
| 2,777,935 | 1/1957 | Schmitt et al. | 219/288 X |
| 2,818,486 | 12/1957 | Schmitt et al. | 219/288 X |
| 2,818,559 | 12/1957 | Manetti et al. | 220/293 X |
| 3,308,267 | 3/1967 | Festermaker | 219/290 |
| 3,518,409 | 6/1970 | Corbett | 219/271 |
| 3,538,306 | 11/1970 | Brunell | 219/272 X |
| 3,579,262 | 5/1971 | Peeps | 219/295 |
| 3,579,263 | 5/1971 | Corbett | 219/295 |
| 3,611,910 | 10/1971 | Hughes | 220/293 X |

FOREIGN PATENT DOCUMENTS

| | | | |
|---|---|---|---|
| 2266 | 12/1931 | Australia | 220/210 |

*Primary Examiner*—A. Bartis

*Attorney, Agent, or Firm*—Emch, Schaffer, Schaub & Todd Co.

[57] ABSTRACT

A safety device for an electrode-type steam vaporizer having an electrode assembly enclosed in a protective housing allows access to the electrodes for cleaning or adjustment only when a key, preferably the electric plug for the vaporizer, is inserted through an opening in the protective housing to release an interlock mechanism normally precluding removal of the protective housing from the electrode assembly. When the protective housing is removed, the key is automatically locked in the opening in the protective housing by a spring-biased lock pin and cannot be removed until the electrode assembly is again repositioned in the housing with the electrode assembly and housing properly assembled relative to each other. The safety device can be used in other electrical appliances, such as a toaster, that have electrical elements enclosed in a protective housing.

6 Claims, 12 Drawing Figures

FIG. 1
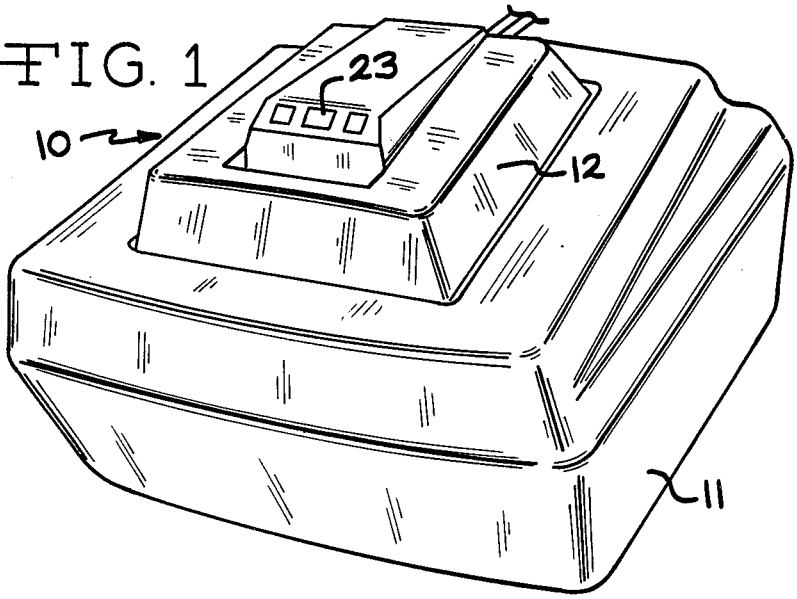
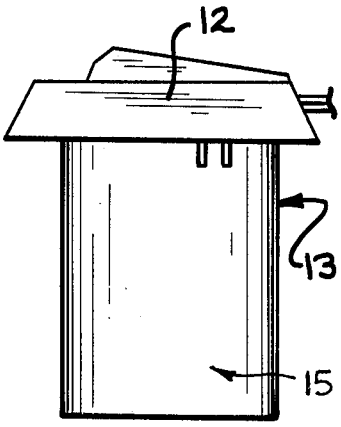
FIG. 2
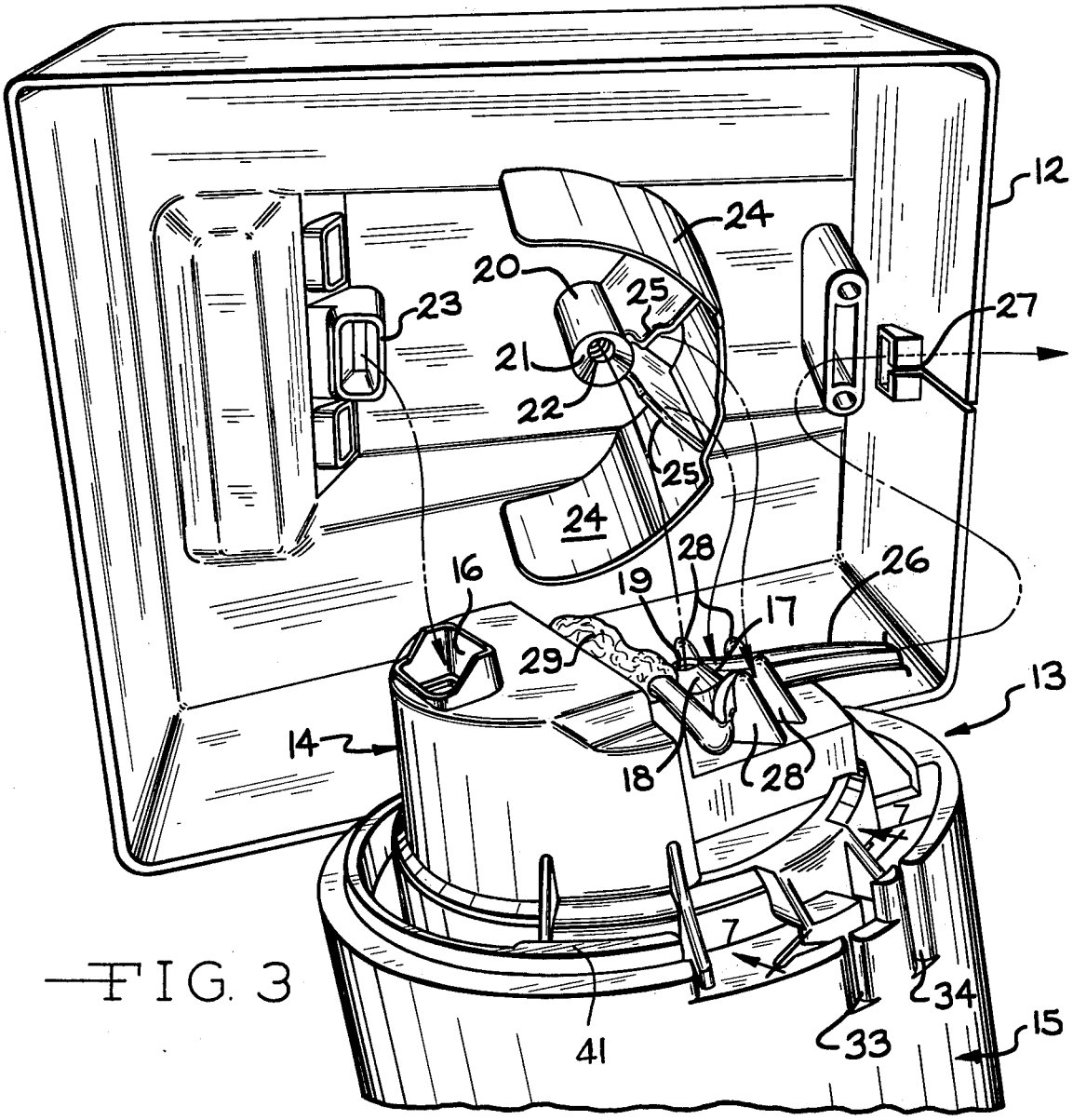
FIG. 3

VAPORIZER WITH ELECTRODE HOUSING INTERLOCK

BACKGROUND OF THE INVENTION

The invention is directed to a safety device for electrical appliances, and particularly to a safety interlock mechanism for steam vaporizers which requires that a key, preferably one of the prongs of the power cord plug, be inserted into an opening in the vaporizer electrode assembly. While the use of a key other than the plug can circumvent the safety features, the use of the power cord plug as the key means, precludes its connection to a live electrical outlet, before the vaporizer electrode unit can be disassembled and reassembled.

DESCRIPTION OF THE PRIOR ART

This invention is useful for electrical appliances having electrical elements that are enclosed in a protective sleeve such as a toaster, steam vaporizers, and other similar appliances. In the case of the steam vaporizers the electrical elements oftentimes consist of two parallel electrodes which are immersed into a reservoir of liquid to be vaporized.

Because of the electrical circuit and the presence of liquid, the danger of an electrical shock is present. The danger is reduced when the electrical elements are placed in a protective sleeve which, while allowing the liquid to contact the elements, prohibits the operator from contacting them. However, the protective sleeve must be removable to permit the cleaning of the electrical elements which are susceptible to fouling by deposits from the vaporized water.

In prior art vaporizers, if the protective sleeve is removed, a serious electrical hazard exists because, the exposed electrodes will be electrically charged if the vaporizer is plugged in. A severe electric shock would be experienced by anyone who touched both electrodes or one electrode and a ground such as a proximate water faucet or metal sink.

SUMMARY OF THE INVENTION

During routine maintenance, a conventional vaporizer having exposed metal electrodes thus has the potential of subjecting the user to severe electrical shock. The instant invention eliminates this shock hazard by requiring that at least one prong of the power cord plug be inserted into a dual function locking mechanism on the vaporizer before it can be disassembled. The locking mechanism is positioned between and selectively engages an electrode mounting assembly and a protective housing. The presence of the plug in the locking mechanism unlocks the protective housing from the electrode mounting assembly and allows the withdrawal of the electrodes from the protective housing thereby facilitating routine cleaning. At the same time, the locking mechanism drives a pin through a hole in one of the prongs of the power cord plug, retaining it in the locking mechanism. The shock hazard is thus eliminated since the line cord plug cannot be removed from the housing and inserted into a power outlet as long as the protective housing is not in place on the electrode assembly. When the housing is reassembled to the electrode assembly, the dual function interlock simultaneously releases the line cord plug as it relocks the protective housing and electrode assembly together. The bare electrically charged electrodes are thus safely contained within the protective housing and the vaporizer may not be disassembled unless the power cord plug is reinserted into the locking mechanism.

The interlocking mechanism is designed to operate when one or both of the prongs of the line cord plug is inserted into the protective sleeve. It is possible, however, to utilize a key means other than the line cord plug to operate the interlocking mechanism. While the design of the interlock mechanism seeks to minimize the dangers occasioned by bare electrically charged electrodes, it is quite obvious that a determined individual can circumvent the safety features of this invention.

It is a primary object of this invention to provide an electric device having a novel locking mechanism.

It is a still further object of the invention to provide an interlocking mechanism which is easily fabricated of the materials commonly used in such electrical devices.

Other objects and applications of this invention will become apparent from the following detailed description and drawings of the preferred embodiment of the invention.

BRIEF DESCRIPTION OF THE DRAWINGS

FIG. 1 is a perspective view of an electric steam vaporizer of the present invention;

FIG. 2 is a side elevational view of a vaporizer cell assembly and cover;

FIG. 3 is a fragmentary, exploded, perspective view of the vaporizer cell assembly with the cover tilted rearward;

DESCRIPTION OF THE PREFERRED EMBODIMENT

Figure 4:
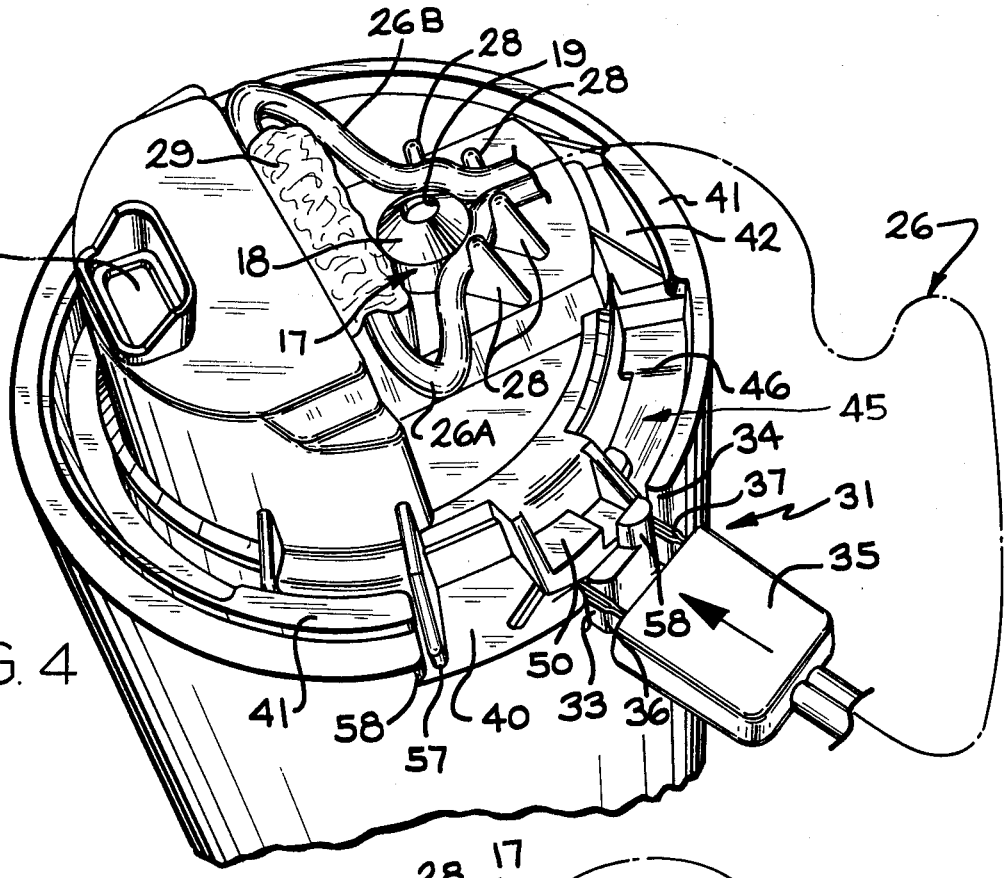
FIG. 4 is a fragmentary perspective view of the vaporizer cell assembly with the electrode assembly locked in position on the protective sleeve.

Although this invention is suitable for use on a variety of electrical appliances, it will be described in relation to use with a steam vaporizer. Such description is solely for the sake of explanation and is not intended to limit the scope of the invention.

Referring to FIG. 1 and 2, an electric steam vaporizer according to the present invention is indicated by the reference number 10. The vaporizer 10 includes a liquid reservoir 11 and a cover 12. In the preferred embodiment, the reservoir 11 has a generally flat horizontal upper surface having a circular opening which is concealed by a cover 12. In FIG. 2 the cover 12 is removed from the reservoir 11 and a vaporizer cell assembly 13 which is attached to the cover 12 may be seen.

Referring now to FIG. 3, the vaporizer cell assembly 13 comprises a base or an electrode assembly 14 and demountable protective sleeve 15. The electrode assembly 14 and protective sleeve 15 are generally molded from a resilient moldable thermoplastic material, such as polypropelyene. The sleeve 15 has spaced apart inner and outer walls 60, 61, the inner wall 60 forming a chamber having an inlet to allow water to enter the chamber from the reservoir 11. The protective sleeve 15 thus limits the amount of water heated by the electrode assembly at any one time as well as protecting the components of the electrode assembly 14. Further details of the electrode assembly 14 and protective sleeve 15 are disclosed in U.S. Pat. Nos. 3,518,409 and 3,579,263 and it will therefore not be described here in greater detail.

The electrode assembly 14 includes a port 16 through which the vapors generated within the vaporizer cell assembly 13 escape to the atmosphere. The electrode assembly 14 further includes a post 17 having a frusto-conical surface 18 and radially centered vertical opening 19. The cover 12 includes a post 20 having an inverted frusto-conical surface 21 inclined at an angle complementary to the angle of surface 18 on the electrode assembly 14. The post 20 also includes a radially centered threaded opening 22. The assembly of the cover 12 to the vaporizer assembly 13 is accomplished by juxtaposing the complementary surfaces 18 and 21 and inserting a threaded fastener (not shown) from below through the opening 19 and into the threaded opening 22.

The cover also includes a port 23 which, when the cover 12 is in place upon the vaporizer cell assembly 13, aligns with the port 16 in the electrode assembly 14 and allows the vapor produced by the vaporizer cell assembly 13 to escape to the atmosphere. The cover 12 further includes a semi-circular shield 24 which depends from the cover 12. The shield 24 is braced by two radially disposed ribs 25 which interconnect the shield 24 with the post 20. A line cord 26 which generally terminates on the electrode assembly 14 passes through the cover 12 in a rectangular opening 27.

With reference now to FIGS. 3 and 4, the means for retaining the line cord 26 on the electrode assembly 14 will be described. The line cord 26 is composed of two individual leads 26A and 26B and one lead is positioned on each side of the post 17, between the post and a pair of vertically disposed pins 28. When the cover 12 is assembled to the vaporizer cell assembly 13, the ribs 25 seat between each pair of pins 28 and compressively retain each lead 26A and 26B of the line cord 26. The ends of the line cord leads 26A and 26B are attached to the vaporizing electrodes (visible in FIG. 6) by suitable electrically conductive connecting means protected from moisture and other contaminants by a covering of insulating sealant 29.

Figure 5:
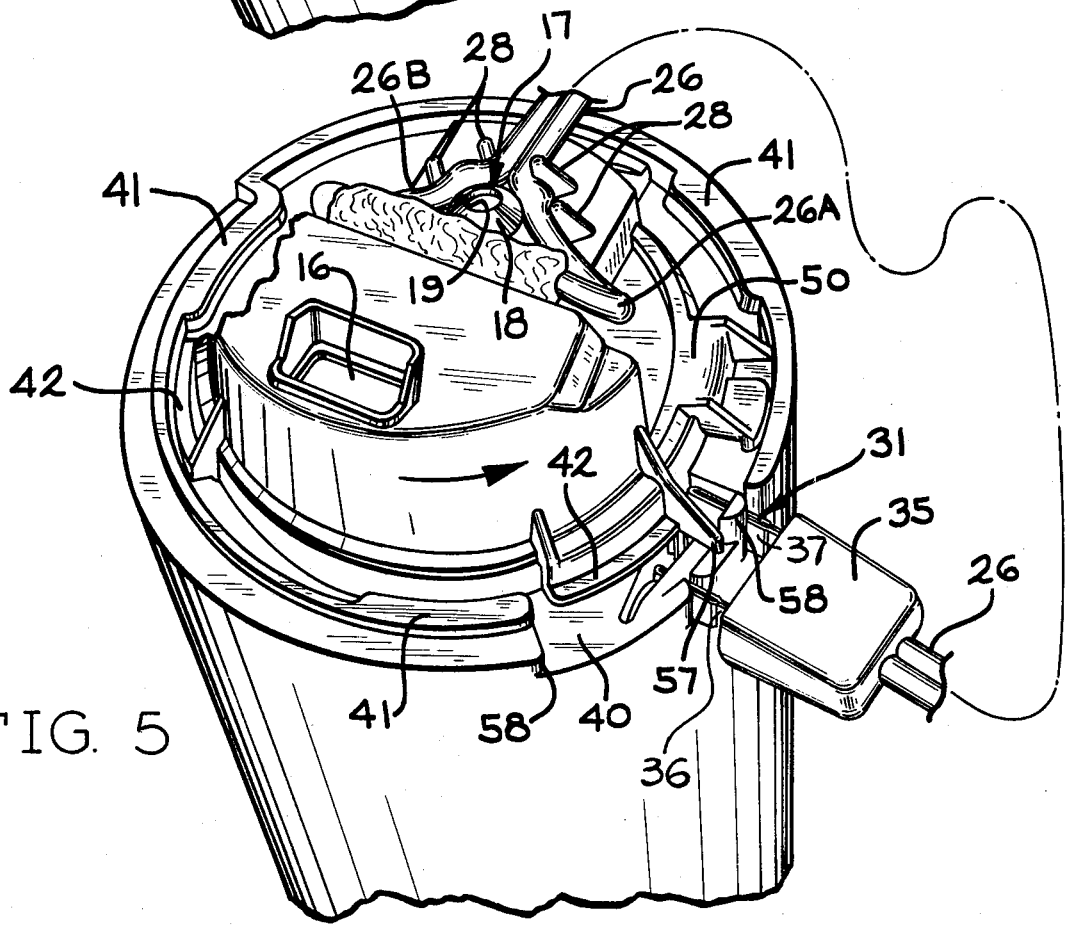
FIG. 5 is a fragmentary perspective view of the vaporizer cell assembly with the electrode assembly in an unlocked position on the protective sleeve.
Figure 6:
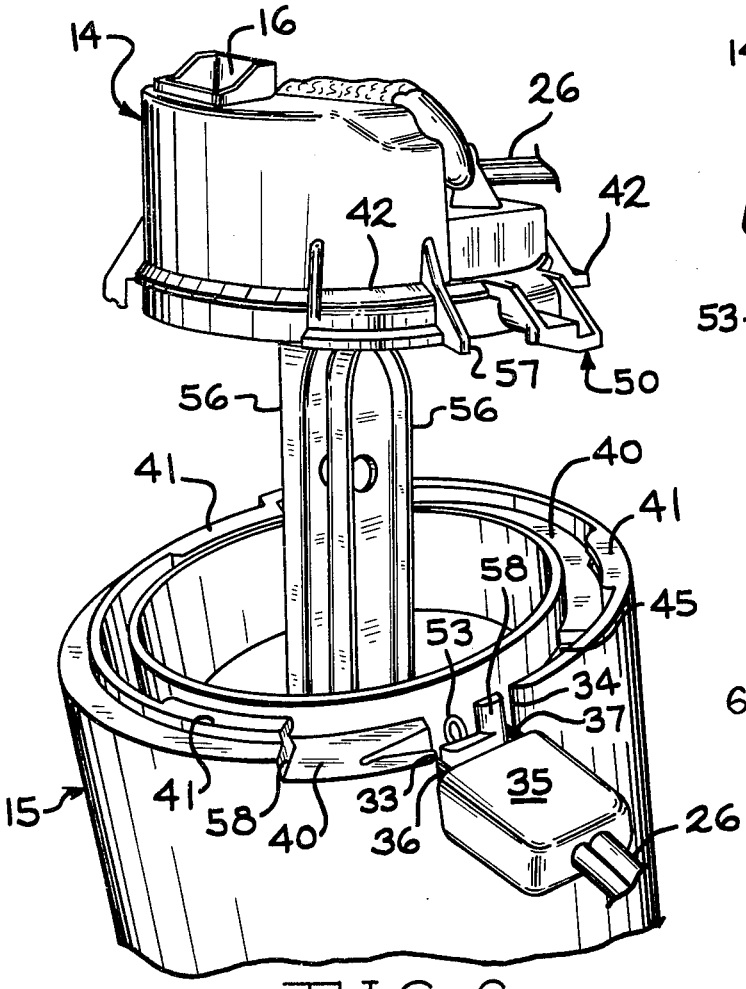
FIG. 6 is an exploded, fragmentary, perspective view of the electrode assembly and protective sleeve.

The external components and operation of a safety interlock mechanism 31 can be seen in the sequence of FIGS. 3, 4, 5 and 6. The protective sleeve 15 includes a left aperture or slot 33 and a right aperture or slot 34 spaced apart at the conventional AC line cord prong spacing. The line cord 26 includes a conventional plug 35 having two identical prongs 36 and 37. However, because the prongs perform different functions when inserted into the slots 33 and 34 of the protective sleeve 15, they will be identified individually as left prong 36 and right prong 37. FIG. 6 best illustrates the structures which retain the protective sleeve 15 on the electrode assembly 14. The protective sleeve 15 has a recessed generally horizontal surface 40 adjacent its upper end and three inwardly directed overhanging lips 41 spaced at equal intervals around the periphery of the outer wall 61. The base or electrode assembly 14 has three radially extending projections or tabs 42 spaced at equal intervals around its lower periphery. When rotated into radial alignment as shown in FIG. 4, the overhanging lips 41 on the protective sleeve 15 engage the projecting tabs 42 on the electrode assembly 14 thereby securing the electrode assembly 14 to the protective sleeve 15. Conversely, the electrode assembly 14 may be rotated relative to the protective sleeve 15 such that the overhanging lips 41 no longer engage the projecting tabs 42 and the electrode assembly 14 may be removed from the protective sleeve 15, as is illustrated in FIGS. 5 and 6. It should be understood, however, that the disassembly procedure just described is by way of explanation only and does not consider the operation of the interlock mechanism 31 which will be described subsequently.

Figure 7:
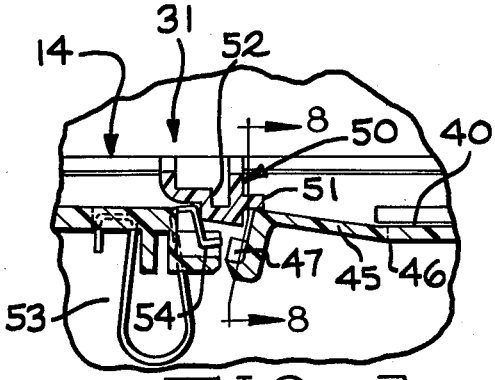
FIG. 7 is a fragmentary, sectional view of the locking mechanism taken along line 7—7 of FIG. 3.

Referring now to FIGS. 6 and 7, it will be appreciated that the recessed surface 40 extends in substantially a full circle and joins the inner and outer walls of the protective sleeve 15 in essentially all but the radial segment of the sleeve 15 adjacent the prong openings 33 and 34. Adjacent the prong opening 34 is an interlock member or tab 45. The interlock tab 45 is positioned between and spaced from the inner and outer walls 60, 61 of the protective sleeve 15 and extends to the right of the prong opening 34, merging with the recessed surface 40 at a junction 46. The interlock tab 45 is inclined with respect to the recessed surface 40 when it is undisturbed but the interlock tab can be moved upward or downward about the junction 46 due to the somewhat resilient nature of the material of which the interlock tab 45 is molded.

Figure 8:
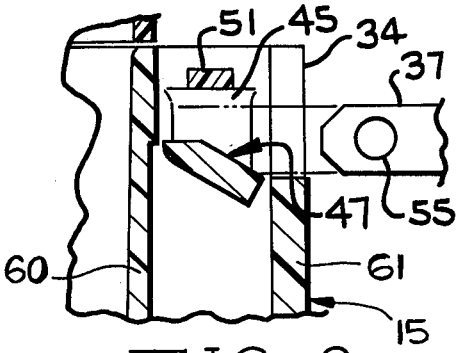
FIG. 8 is a fragmentary, sectional view of the locking mechanism taken along line 8—8 of FIG. 7.

Referring now to FIGS. 7 and 8, the interlock tab 45 includes an inclined surface 47 in alignment with or in registry with the right prong opening 34 such that the right prong 37 of a power cord plug, not in FIG. 7 or 8, will engage the inclined surface 47 when inserted into the right prong opening 34. FIG. 8 illustrates the right prong 37 of the power cord plug about to be inserted into the right prong opening 34. The interlock member or tab 45 is shown in its undisturbed position, that is, inclined with respect to the recessed surface 40.

Figure 10:
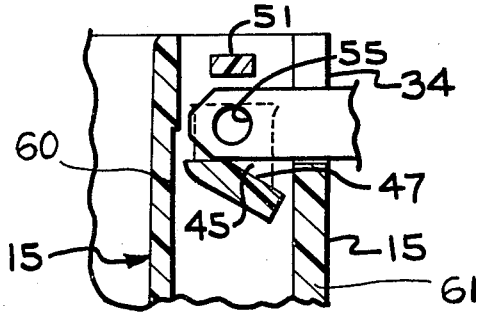
FIG. 10 is a fragmentary, sectional view of the locking mechanism taken along line 10—10 of FIG. 9.

Reference to FIG. 10 discloses the second position of the interlock tab 45 in which the right prong 37 of the power cord plug 35 has been inserted fully into the right prong opening 34 thus depressing the interlock tab 45 somewhat below the plane of the recessed horizontal surface 40. Thus, it can be appreciated that the insertion or withdrawal of the prong 37 in the prong opening 34 and into engagement with the inclined surface 47 of the interlock tab 45, lowers or raises, respectively, the interlock tab 45.

Referring again to FIG. 7, a rotational stop 50 is molded into the electrode assembly 14. When the protective sleeve 15 is positioned on the electrode assembly 14, the rotational stop 50 seats in the space between the inner and outer walls 60, 61 of the protective sleeve 15 and is approximately coplanar with the recessed surface 40. The relative radial positions of the tabs 42 and the rotation stop 50 on the electrode assembly 14 and the overhanging lips 41 and interlock tab 45 on the protective sleeve 15 are such that the tabs 42 are aligned with the overhanging lips 41 and retain the protective sleeve 15 on the electrode assembly 14 when the rotation stop 50 is positioned marginally to the left of the interlock tab 45 such that the assembly 14 and sleeve 15 are locked together. When the tabs 42 are not engaged by the overhanging lips 41 the rotation stop 50 is to the right of the interlock tab 45 as is illustrated in FIG. 11, allowing the protective sleeve 15 to be removed from the electrode assembly 14.

Referring again to FIGS. 7 and 8, the rotation stop 50 includes a vertical stop 51 which engages the upper surface of the interlock tab 45 and prevents excessive upward motion of the interlock tab 45 which might allow the right prong 37 to engage a surface of the interlock tab 45 other than the intended inclined surface 47.

Figure 9:
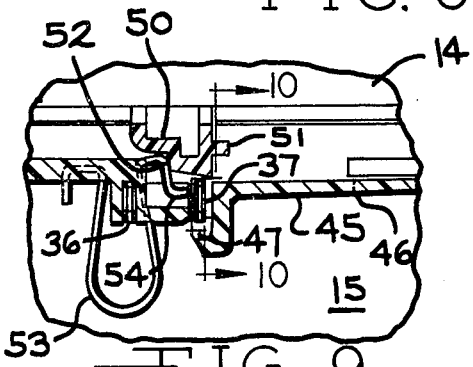
FIG. 9 is a fragmentary, sectional view of the locking mechanism similar to FIG. 7 after the plug has been inserted.

Referring now to FIG. 9, the portion of the interlock mechanism 31 which retains the line cord plug 35 in the protective sleeve 15 while the electrode assembly 14 is separated from it will now be described. In FIG. 9, the left prong 36 and the right prong 37 are illustrated in position in the respective left prong opening 33 and right opening 34 of the protective sleeve 15. The presence of the prong 37 in the opening 34 and in engagement with the inclined surface 47 has depressed the interlock tab 45 in the fashion just described. It should be noted that prong 37 also bears against the lower surface of rotational stop 50 to assure adequate clearance between the stop and the interlock tab 45 to allow the stop to pass along the upper surface of the interlock tab. Thus, the electrode assembly 14 to which the rotation stop 50 is attached is free to rotate in one direction relative to the protective sleeve 15 in preparation for their separation. The rotation stop 50 also includes a vertical surface 52 which is contacted by a U-shaped spring 53. The U-shaped spring 53 is secured at its opposite end in the protective sleeve 15 and is compressed to the position shown in FIG. 9 or relaxed to the position shown in FIG. 11 by its contact with the vertical surface 52 of the rotation stop 50. The free end of the U-shaped spring 53 nearest the vertical surface is formed to include a substantially horizontally extending portion 54.

Figure 11:
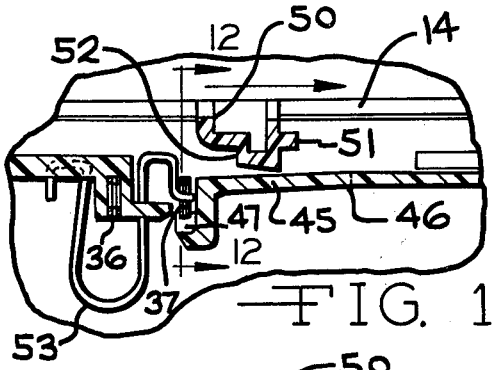
FIG. 11 is a fragmentary, sectional view of the locking mechanism after the electrode assembly has been unlocked from the sleeve.
Figure 12:
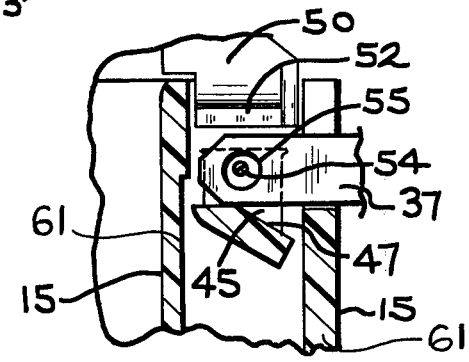
FIG. 12 is a fragmentary, sectional view of the locking mechanism taken along line 12—12 of FIG. 11.

With reference now to FIGS. 9 and 11, it can be appreciated that as the rotation stop 50 and vertical surface 52 against which the U-shaped spring 53 rests, is moved towards and along the upper surface of the interlock tab 45, the U-shaped spring 53 relaxes and the horizontal end 54 of the U-shaped spring 53 extends into and through an opening 55 in the right prong 37. The extension of the end 54 of the U-shaped spring 53 may also be seen in the section view, FIG. 12. When the interlock tab 45 has been depressed due to the presence of a power cord plug 35 having been inserted into the openings 33 and 34, the rotation stop 50 will be freed, allowing the electrode assembly 14 to be disassembled from the protective sleeve 15 while simultaneously the horizontal end 54 of the U-shaped spring 53 will extend into and through the opening 55 in the prong 37 and will retain the power cord plug 35 in the protective sleeve 15. Therefore, cleaning of two electrodes 56 which are visible in FIG. 6 may be accomplished safely since the interlock mechanism 31 precludes the possibility that the power cord plug 35 may be inserted into a power outlet while the electrodes 56 are exposed.

Subsequent to the cleaning and adjustment of the electrodes 56, the electrode assembly 14 is repositioned on the protective sleeve 15 such that the tabs 42 are vertically adjacent the recessed surface 40 and a radially extending positioning pin 57 is between a pair of stops 58 on the periphery of the protective sleeve 15. The electrode assembly 14 is then rotated relative to the protective sleeve 15 to have the overhanging lips 41 on the protective sleeve engage the tabs 42 on the electrode assembly to secure the protective sleeve to the electrode assembly. When the electrode assembly is rotated the vertical surface 52 compresses the U-shaped spring 53 and the horizontal end 54 of the spring 53 retracts from the aperture or opening 55 in the right prong 37 of the power cord plug 35 permitting the removal of the power cord plug 35 from the protective sleeve 15. The removal of the power cord plug 35 from the openings 33 and 34 in the protective sleeve 15 then allows the interlock tab 45 to return to the position shown in FIG. 7. Thus the electrode assembly 14 is relocked to the protective sleeve 15 by the action of the interlock tab 45 and stop 50 and the vaporizer cell assembly 13 is again ready for use.

Although the above interlocking mechanism has been described with both prongs of the line cord plug being inserted into the protective sleeve, it should be noted that only one prong needs to be inserted into the sleeve to operate the interlocking mechanism. In addition, any projection or other key means could be used to deflect the locking member or tab in place of a prong from a line cord plug.

It will be apparent to those skilled in the art that various modifications may be made to the preferred embodiment described above without departing from the spirit and scope of the following claims.

We claim:

1. An electrical device comprising:

a base containing an exposed electrical element, said base having a series of spaced projections and a stop member located thereon;

a removable protective sleeve enclosing said electrical element and having a series of spaced lips located thereon, said lips adapted to be brought into mating relationship with said projections on said base by movement of said base and said protective sleeve relative to each other, said lips engaging said projections on said base to secure said protective sleeve to said base, said protective sleeve defining at least one aperture;

an integral resilient interlock member positioned on the interior of said protective sleeve in alignment with the sleeve aperture, said integral interlock member engaging said stop member to prevent relative movement between said base and said sleeve, thereby precluding disengagement of said projections and lips once said protective sleeve has been secured to said base;

key means for insertion into the aperture on said protective sleeve to contact and deflect said resilient interlock member from engagement with said stop member on said base to allow relative movement between said base and said sleeve, thereby allowing removal of said protective sleeve from said base by disengagement of said projection and said lips, said key means defining a locking recess, and key locking means comprising a releasable spring-biased pin positioned on said sleeve adjacent the aperture in said protective sleeve; and actuator means on said base for releasing said spring-bias pin to engage the locking recess in said key means in response to said interlock member being deflected by said key means and said protective sleeve being disengaged from said base.

2. The electrical device of claim 1 wherein said actuator means for said key locking means comprses said stop member of said base, said stop member biasing said pin away from the aperture in said protective sleeve when said protective sleeve is positioned on said base with said lips and said projections in engagement and said stop member moving to allow said pin to engage the locking recess in said key means when the protective sleeve is positioned for removal from the base.

3. An electrical vaporizer comprising:

a liquid reservoir;

a vaporizer cell assembly containing having an exposed electrical heating means for immersion in said reservoir, the assembly having a plurality of discontinuous circumferential projections and a stop member located thereon;

a protective sleeve for enclosing said heating means and having a plurality of discontinuous circumferential lips located thereon, said lips adapted to be brought into mating relationship with said projections on said vaporizer assembly by relative movement between said vaporizer cell assembly and said sleeve, said lips engaging said projections to secure said protective sleeve to said vaporizer assembly, said protective sleeve defining at least one aperture;

an integral resilient interlock member positioned on the interior of said protective sleeve in alignment with the aperture, said interlock member engaging said stop member of the vaporizer assembly to prevent relative movement between said vaporizer cell assembly and said sleeve thereby precluding disengagement of the projections and lips once said protective sleeve has been secured to said vaporizer assembly;

a power cord having one end electrically connected to the heating means and a pair of prongs, each defining a recess, connected to the other end of said power cord, one of said prongs adopted for insertion into the aperture on said protective sleeve to contact and deflect said interlock member from engagement with said stop member on said vaporizer assembly to allow relative movement between said vaporizer cell assembly and said sleeve thereby allowing removal of said protective sleeve from the vaporizer assembly;

prong locking means comprising a releasable spring-biased pin positioned on said sleeve adjacent the aperture in said protective sleeve; and actuator means on said vaporizer cell assembly for releasing said spring-biased pin into engagement with the prong recess in response to said interlock member being deflected by one of said prongs and said protective sleeve being disengaged from said vaporizer assembly.

4. The vaporizer of claim 3 wherein said actuator means comprises a portion of said stop member which is in engaging relationship with said spring-biased pin.

5. The vaporizer of claim 3 wherein said interlock member includes an inclined surface adjacent the sleeve aperture engageable by said one of said prongs to deflect said interlock member.

6. The vaporizer of claim 5 wherein said interlock member is vertically moveable into and out of engagement with said stop member and said stop member includes a projecting surface for engaging said interlock member and limiting further vertical travel of said interlock member in the direction of engagement between said interlock member and said stop member.

* * * * *